US009394900B2

(12) United States Patent
Roman et al.

(10) Patent No.: US 9,394,900 B2
(45) Date of Patent: Jul. 19, 2016

(54) INTERNAL BELLOWS PUMP FLUID PATH

(76) Inventors: Timothy S. Roman, Minnetonka, MN (US); Kurt R. Sjodin, Cedar, MN (US); Adam L. Kalthoff, Circle Pines, MN (US)

( * ) Notice: Subject to any disclaimer, the term of this patent is extended or adjusted under 35 U.S.C. 154(b) by 122 days.

(21) Appl. No.: 13/643,364

(22) PCT Filed: Apr. 27, 2011

(86) PCT No.: PCT/US2011/034048

§ 371 (c)(1), (2), (4) Date: Oct. 25, 2012

(87) PCT Pub. No.: WO2011/137145

PCT Pub. Date: Nov. 3, 2011

(65) Prior Publication Data

US 2013/0045123 A1 Feb. 21, 2013

Related U.S. Application Data

(60) Provisional application No. 61/329,663, filed on Apr. 30, 2010.

(51) Int. Cl.
*F04B 53/12* (2006.01)
*F04B 43/08* (2006.01)
(Continued)

(52) U.S. Cl.
CPC ..... *F04B 53/12* (2013.01); *F04B 43/084* (2013.01); *F04B 45/02* (2013.01); *F04B 53/125* (2013.01); *F04B 53/14* (2013.01); *F04B 39/10* (2013.01); *F04B 39/123* (2013.01); *F04B 53/10* (2013.01)

(58) Field of Classification Search
CPC ..... F04B 7/00; F04B 43/08; F04B 45/02; F04B 53/12; F04B 53/14; F04B 53/125; F04B 53/10; F04B 39/10; F04B 39/123; F04B 43/084; F04B 5/02; F04B 19/022; F04B 53/126
USPC ..... 417/502, 503, 472, 415, 545, 546, 547, 417/552, 205, 554; 137/565.26, 597
See application file for complete search history.

(56) References Cited

U.S. PATENT DOCUMENTS 1,931,938 A * 10/1933 Pippin ..... F04B 53/12 137/539.5
2,051,243 A * 8/1936 Bowling ..... 417/383
(Continued)

FOREIGN PATENT DOCUMENTS

AT 303531 B 11/1972
AT 303531 B * 11/1972 ..... F04B 21/04
(Continued)

OTHER PUBLICATIONS

Graco Inc. Air-Powered Glutton Pumps Instructions-Parts List, #307843Z Revised Dec. 2003.
(Continued)

*Primary Examiner* — Devon Kramer
*Assistant Examiner* — Jon Hoffmann

(57) ABSTRACT

In a reciprocating piston pump, piston 34 has first or upper end 48 and second or bottom end 50 having inlet 52 and outlet 54 bores respectively located therein. Inlet check 32 is located in bore 52 while outlet check 42 is located in bore 54. As can be seen in FIG. 3, each of bores 52 and 54 branches into three (in the preferred embodiment) flow paths which alternate and are intertwined. It is the unique flow paths incorporating both the inlet and outlet check valves in the piston that are the key features of the invention.

6 Claims, 3 Drawing Sheets

(51) Int. Cl.

| | |
|---|---|
| ***F04B 45/02*** | (2006.01) |
| ***F04B 53/14*** | (2006.01) |
| *F04B 53/10* | (2006.01) |
| *F04B 39/10* | (2006.01) |
| *F04B 39/12* | (2006.01) |

(56) References Cited

U.S. PATENT DOCUMENTS

| | | | | | |
|---|---|---|---|---|---|
| 2,362,139 | A | * | 11/1944 | Kelly | 417/454 |
| 2,563,716 | A | * | 8/1951 | Garancher | 222/324 |
| 2,608,390 | A | * | 8/1952 | Jean | F22G 7/02 122/462 |
| 2,668,656 | A | * | 2/1954 | Booth, Jr | F04B 5/02 417/534 |
| 3,050,002 | A | * | 8/1962 | Harris | F04B 1/00 417/250 |
| 3,356,101 | A | * | 12/1967 | George | A01C 23/042 137/114 |
| 3,492,946 | A | * | 2/1970 | Martin | F04B 5/00 417/401 |
| 4,139,333 | A | * | 2/1979 | Sipos | F04B 43/084 417/430 |
| 4,425,083 | A | * | 1/1984 | Peterson | F04B 47/08 417/554 |
| 4,425,086 | A | * | 1/1984 | Peterson | F04B 47/08 417/383 |

FOREIGN PATENT DOCUMENTS

| | | | |
|---|---|---|---|
| EP | 1813810 | A2 | 8/2007 |
| FR | 752394 | A | 9/1933 |
| GB | 302695 | | 1/1930 |
| GB | 419859 | A | 11/1934 |

OTHER PUBLICATIONS

Binks 12:1 Exel Air Powered Pump manual, copyright 2006.
Binks Maple 15 Pump Instruction Manual, updated Oct. 18, 2012 considered prior art general knowledge.
Kremlin FLOWMAX AIRMIX Proportioning Pump Manual, Nov. 4, 2008 revision.
English Summary of Japanese Office Action, Application No. 2013-508183, Feb. 17, 2015, 2 pages.

* cited by examiner

INTERNAL BELLOWS PUMP FLUID PATH

TECHNICAL FIELD

This application claims the benefit of U.S. application Ser. No. 61/329,663, filed Apr. 30, 2010, the contents of which are hereby incorporated by reference.

BACKGROUND ART

In a typical reciprocating piston pump, there is a seal that separates the high pressure working fluid from the atmosphere surrounding the pump. Even in perfect conditions, these seals can weep a small amount of fluid each cycle and this can be detrimental to seal life. The fluid can solidify or crystallize and be pulled back into the seal, shortening the seal life. Historically one way to deal with this small amount of leakage has been a flexible bellows seal 12, which creates a pump 10 without an exposed sliding seal. In this design, the inlet 14 of the pump 10 is routed past the high pressure seal and the resulting low pressure inlet chamber 16 is sealed by the bellows 12 which creates an air tight seal, see FIG. 1. The fluid must then be routed to the bottom of the pump 10 to be ingested below the piston, past the inlet check ball. This has historically been done by mounting an external manifold on the pump to route the fluid around the main pumping chamber and feed the inlet of the pump.

DISCLOSURE OF THE INVENTION

The invention negates the need for an external manifold by creating a path through the piston rod and piston of the pump, see FIG. 2. Previous designs have incorporated a hollow piston rod, but still required a separate manifold or flow path for the outlet check valve. This invention incorporates both check valves into the piston. This is done by alternating three inlet and outlet flow paths 60 degrees apart, see FIG. 3. It is the unique flow paths incorporating both the inlet and outlet check valves in the piston that are the key features of the invention.

These and other objects and advantages of the invention will appear more fully from the following description made in conjunction with the accompanying drawings wherein like reference characters refer to the same or similar parts throughout the several views.

BEST MODE FOR CARRYING OUT THE INVENTION

Figure 1:
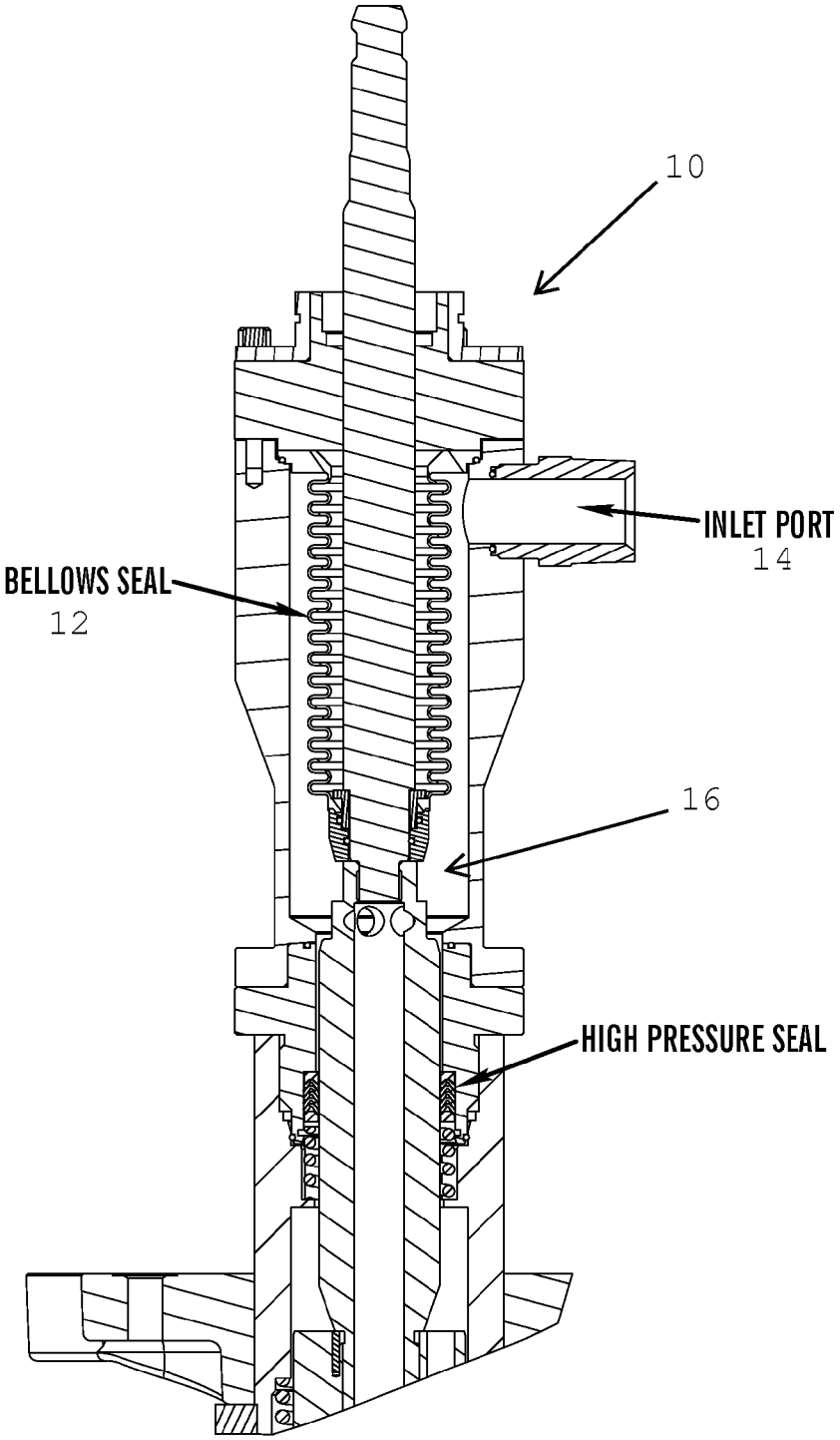
PRIOR ART FIG. 1
FIG. 1 shows a prior art bellows pump.
Figure 2:
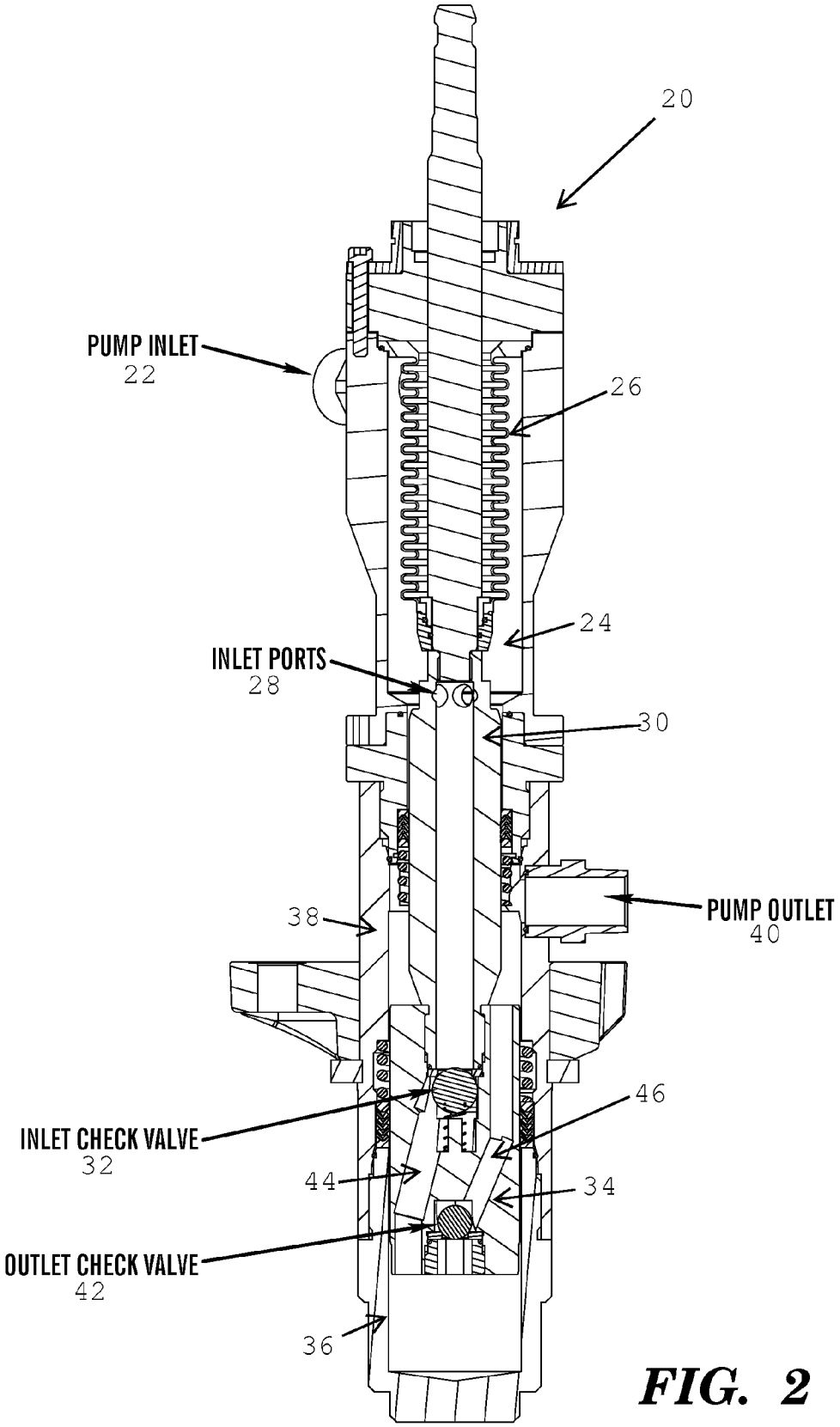
FIG. 2 shows a cross-section of the pump of the instant invention.
Figure 3:
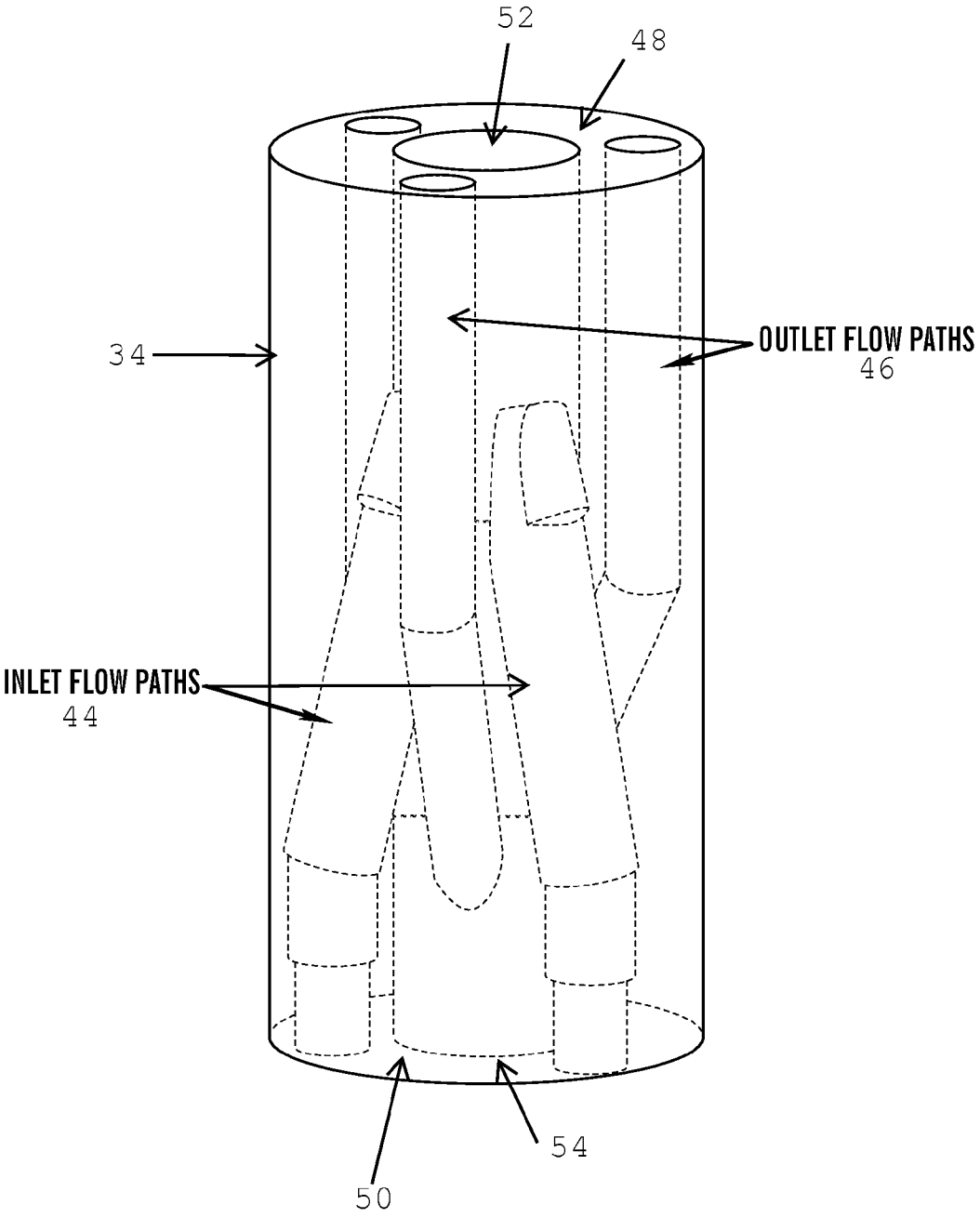
FIG. 3 shows the piston and its flow paths.

The pump, generally 20, of the instant invention is shown in FIGS. 2 and 3. Pump 20 has a pump inlet 22 leading to inlet chamber 24. Chamber 24 is sealed from the outside by bellows seal 26. Inlet ports 28 are provided in hollow piston rod 30 and lead to inlet check valve 32 in piston 34 which slides in cylinder 36 which is part of housing 38. A pump outlet 40 is located in housing 38. Within piston 34 is outlet check valve 42.

The invention negates the need for an external manifold by creating a path through the piston rod 30 and piston 34 of the pump 20 as can be seen in FIG. 2. This invention incorporates both check valves 32 and 42 into the piston 34. This is done by alternating three inlet 44 and outlet 46 flow paths 60 degrees apart as shown in FIG. 3.

Piston 34 has first or upper end 48 and second or bottom end 50 having inlet 52 and outlet 54 bores respectively located therein. Inlet check 32 is located in bore 52 while outlet check 42 is located in bore 54. As can be seen in FIG. 3, each of bores 52 and 54 branches into three (in the preferred embodiment) flow paths (inlet 44 and outlet 46) which alternate and are intertwined. It is the unique flow paths incorporating both the inlet and outlet check valves in the piston that are the key features of the invention.

It is contemplated that various changes and modifications may be made to the bellows pump fluid path without departing from the spirit and scope of the invention as defined by the following claims.

The invention claimed is:

1. A reciprocating piston pump comprising:

a piston rod connected to the piston;

a pump housing that includes a cylinder;

a piston movable within the cylinder, the piston having a first end and a second end;

an inlet check valve located in the first end of the piston;

an outlet check valve located in the second end of the piston;

a plurality of inlet passages extending through the piston from the inlet check valve to the second end of the piston; and a plurality of outlet passages extending through the piston from the outlet check valve to the first end of the piston, wherein the plurality of outlet passages are spaced from one another and are spaced from the plurality of inlet passages;

wherein the inlet check valve and the outlet check valve are in axial alignment with the piston rod.

2. The reciprocating piston pump of claim 1, wherein the inlet passages and the outlet passages are circumferentially spaced in an alternating pattern.

3. The reciprocating piston pump of claim 2, wherein the plurality of inlet passages comprises three inlet passages, and wherein the plurality of outlet passages comprises three outlet passages.

4. The reciprocating piston pump of claim 1 and further comprising:

an inlet chamber through which the piston rod extends;

a pump inlet connected to the inlet chamber; and a pump outlet connected to the cylinder.

5. The reciprocating piston pump of claim 4, wherein the piston rod includes a hollow section with a passage that is connected to a plurality of inlet ports at a first end of the passage and is connected to the inlet check valve at a second end of the passage.

6. The reciprocating piston pump of claim 5, and further comprising:

a bellows seal surrounding a portion of the piston rod, wherein the bellows seal is positioned to seal the chamber from atmosphere surrounding the reciprocating piston pump.

* * * * *